United States Patent [19]

Permut et al.

[11] 4,155,042

[45] May 15, 1979

[54] DISASTER ALERT SYSTEM

[76] Inventors: Albert A. Permut; Alan R. Permut; Ronald M. Permut, all of 6995 Sweetwater Ct., Boulder, Colo. 80301

[21] Appl. No.: 846,679

[22] Filed: Oct. 31, 1977

[51] Int. Cl.[2] ..... G08B 25/00

[52] U.S. Cl. ..... 325/64; 325/466; 358/93; 340/293

[58] Field of Search ..... 325/51, 53, 54, 55, 325/64, 466, 492; 340/224, 412, 215; 358/93

[56] References Cited

U.S. PATENT DOCUMENTS

| | | | |
|---|---|---|---|
| 3,521,168 | 7/1970 | Kaiser et al. | 325/53 |
| 3,914,692 | 10/1975 | Seaborn, Jr. | 325/55 |
| 3,986,119 | 10/1976 | Hemmer, Jr. et al. | 325/53 |

*Primary Examiner*—Robert L. Griffin
*Assistant Examiner*—Edward L. Coles

[57] ABSTRACT

A disaster alert system is disclosed which consists of two major sub-systems. The first sub-system is a central disaster alert station which transmits coded R.F. activation signals specifying the geographic area and/or the official personnel to be alerted. Said central disaster alert station also transmits audio signals containing the disaster warning message to be disseminated to potential disaster victims and/or pre-selected official personnel.

The second and companion sub-system consists of a plurality of independent and remotely located disaster alert modules which can be placed in any location to which disaster alert information is to be disseminated. Said disaster alert modules operate on continuous low-power standby, receiving and analyzing R.F. signals of a pre-determined carrier frequency and bandwidth. In the absence of said coded activation signal, said disaster alert modules remain in low-power standby. Detection and decoding of said coded activation signals results in activation of the module main power circuits. Activation of main power circuits results in a plurality of module outputs, including but not limited to, production of a clearly audible alarm signal, display of a clearly visible alarm signal, reproduction of the audio message, and activation of desirable auxiliary units equipped with said modules, such as, but not limited to, television receivers, public address systems, and civil defense sirens. Specially designated disaster alert modules located on or near roadways produce, upon similar activation, conspicuous alarm signals, and display disaster alert information on road signs.

Said disaster alert modules operate on self contained battery power with means provided for continuous or occasional re-charging from A.C. lines. Said disaster alert modules remain operative in the event of A.C. power failure. The low-power standby mode is intended to conserve energy and maintain extended battery life, and to preclude discernible outputs when no disaster conditions exists.

23 Claims, 4 Drawing Figures

DISASTER ALERT SYSTEM

BACKGROUND OF THE INVENTION

1. Field of the Invention

The present invention generally relates to warning devices and, more particularly to a communication system for providing immediate alert, warning, and information, in the case of imminent or existing disaster conditions, to any potentially effected persons.

2. Description of the Prior Art

Existing disaster warning systems utilize fixed warning sirens, mobile public address systems carried by police or other official vehicles, or commercial radio and television broadcasts. The use of fixed sirens suffers several significant disadvantages including: inability to provide adequate warning to remote, sparsley populated areas; inability to provide warning to individuals within sound attenuating structures; inability to communicate the nature of disaster conditions or to convey instructional information; ineffectiveness due to lack of public awareness and understanding of the significance of siren warnings. Mobile public address systems suffer the following disadvantages: requirement of considerable time to mobilize and deploy units; requirement of considerable time to traverse area to be warned, with probable omission of some areas; requirement of considerable expenditure of manpower. Commercial radio and television broadcast of warnings suffer the disadvantage that large segments of the population may not be listening to or viewing such broadcasts at any given time. Any warning system which becomes discernibly active during periods when no genuine disaster conditions exist, or which shares output elements utilized by other emergency procedures occasionally or frequently in use, looses effectiveness due to false alarm production and/or psychological desensitization. The above disadvantages greatly limit the effectiveness of existing disaster warning systems. A need therefore exists for a new disaster alert system which does not suffer from the above disadvantages and limitations.

OBJECTS AND SUMMARY OF THE INVENTION

It is the primary object of the present invention to provide a new improved disaster alert system, capable of alerting a very high percentage of citizens in a given area of impending or existing natural or man-made disaster.

A further object of the present invention is to provide a new disaster alert system which does not require the use of fixed sirens, or mobile public address systems.

Yet a further object of the present invention is to provide a new disaster alert system which utilizes a plurality of independent disaster alert modules each of which can be operated at any convenient location within a residence, office, school, factory, or motor vehicle, with minimal long term energy consumption and immunity to general or localized A.C. power failure.

Another object of the present invention is to provide a new disaster alert system which maintains all output functions in a quiescent state in the absence of disaster conditions, thus significantly reducing ineffectiveness due to psychological desensitization.

Yet another object of the present invention is to provide a new disaster alert system with said disaster alert modules each of which when activated by a coded signal from a central disaster alert station produce an audible alarm, visual alarm, and an audio warning and information message, as well as other desirable auxillary functions.

Still another object of the present invention is to provide a new disaster alert system which provides immediate disaster warning to remote public areas such as roadways and parks.

These and other objects of the present invention are achieved by providing a disaster alert system which consists of two major sub-systems. The first sub-system is a central disaster alert station capable of transmitting coded activation signals, as well as conventional audio content signals utilizing the R.F. spectrum of electromagnetic radiation. The second and companion sub-system consists of a plurality of independent and remotely located disaster alert modules which receive said transmitted signals from said first sub-system, and respond, with disaster alert signals and audio messages, to said transmitted signals containing the proper activation code.

More specifically, said central disaster alert station, the first sub-system, transmits a coded R.F. first signal containing information designating the geographic area and/or those pre-selected official personnel, to be alerted. A second R.F. signal is transmitted which contains the audio message portion of the disaster alert, for example a description of the disaster conditions and instructions to potential victims and/or pre-selected official personnel. Said first and second transmitted signals may be electronically multiplexed.

Said plurality of independent remotely located disaster alert modules, the second sub-system, operates on continuous low-power consumption standby, receiving R.F. signals of pre-selected bandwidth and carrier frequency. In the absence of said appropriate coded first signal, said disaster alert modules, the second sub-system, remain in low-power standby condition, without passing information to the output circuitry. In said low-power standby condition, a tuned R.F. receiver circuit and low-power decoder circuit, within the disaster alert module, detect the presence of said appropriate coded first signal when it exists. Decoding of said first signal activates module main power circuits. Activation of said main power circuits results in operation of a plurality of output means. A first output means is provided to produce a clearly audible tone or alarm signal which persists for a predetermined time. A second output means is provided to produce for a predetermined time a readily visable signal such as, but not limited to, a flashing light. A third output means is provided to deliver the audio message transmitted, via said second signal, from said central disaster alert station, first sub-system. A fourth output means is provided to activate additional auxiliary units such as, but not limited to, a television receiver, a public address system, or a civil defense siren, said auxiliary units having been modified or retro-fitted with said second sub-system disaster alert control circuits. Additionally, specially designated disaster alert modules located adjacent to highways or the like, are provided with output means to apply power to electronic, lighted road signs, or to activate a mechanical release mechanism to display disaster alert information on conventional printed road signs. On said highway installations output means are provided to activate clearly visible and/or audible alarms to attract attention to said road signs.

Said individual disaster modules operate on self contained battery power, with a means provided for continuous or occasional re-charging with A.C. lines. This enables said disaster alert modules to remain operable over extended time periods in the event of general or localized A.C. power failure. Also, a means is provided to return the disaster alert module to low-power consumption standby condition after disaster signaling and message transmission are completed. Operation of said disaster alert modules in the low-power consumption standby condition is intended to conserve energy, and maintain extended battery life when disaster alert signals are not being transmitted from the central disaster alert station. Said low-power standby condition is also intended to preclude discernible output functions when no disaster conditions exist.

The novel features of the invention are set forth in the appended claims. The invention will best be understood from the following description when read in conjunction with the accompanying drawings.

DESCRIPTION OF THE PREFERRED EMBODIMENTS

Figure 1:
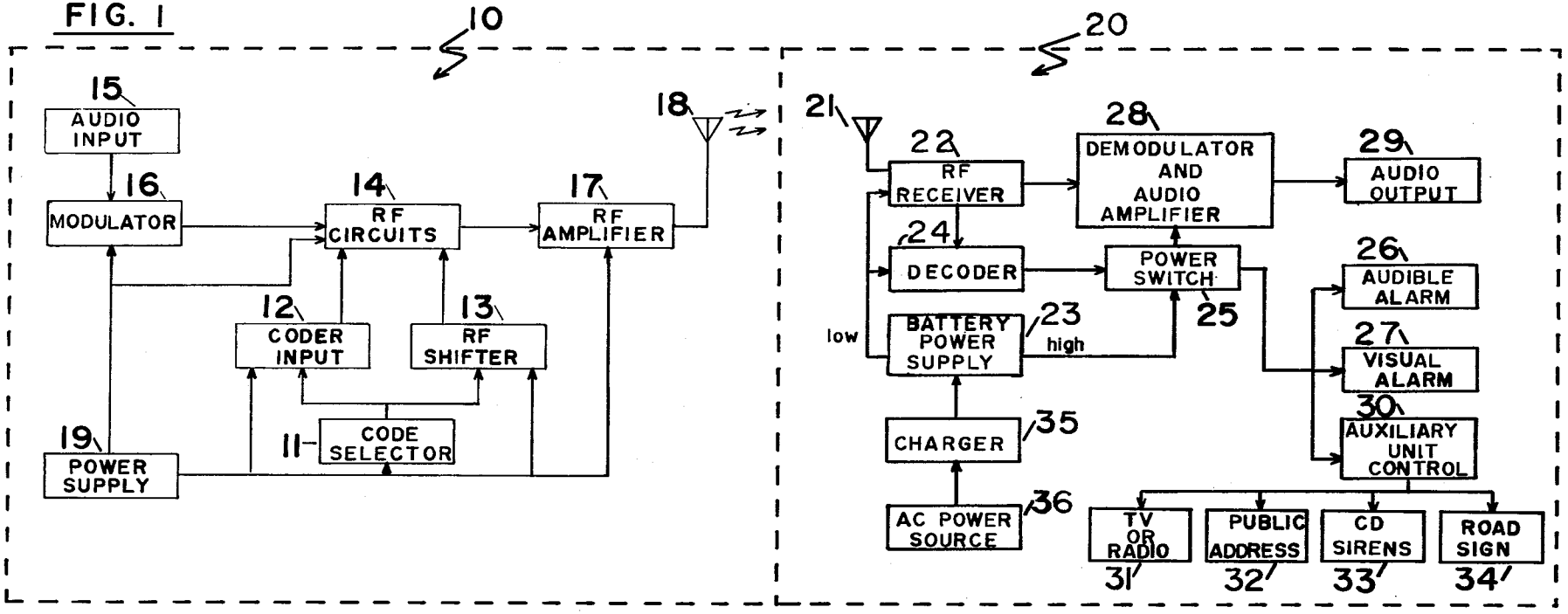
FIG. 1 is a block diagram of one embodiment of the invention.

Referring to FIG. 1, which represents the system of the present invention diagrammed in block form, reference numeral 10 designates the first sub-system, a specially adapted transmitter, hereafter called central disaster alert station. Reference numeral 20 designates the second sub-system, a specially adapted receiver, hereafter called disaster alert module(s).

Included in the first sub-system, 10, is a code selector 11, which provides a code, selected from a plurality of codes, which designates the desired geographic area and/or pre-selected official personnel to be alerted. Code selector 11 controls coder input 12 and the radio frequency shifter 13, the latter of which may shift the transmitter carrier frequency to a protected frequency, by its action on the RF circuits, 14. The coder input 12 also supplies its output to the RF circuits 14. Thus the coder input 12 supplies the RF circuits 14 and RF amplifier 17 with the coded first signal, hereafter called the module activation signal, which is transmitted via the antenna 18.

Also included in the first sub-system 10 is an audio input means 15 which may utilize a microphone or the like, for live audio input, or may utilize pre-recorded input. The output of the audio input means 15 is connected to the modulator 16 which provides its signal to the RF circuits 14. This output of the RF circuits 14 is also supplied to the RF amplifier 17 and thus a second signal, hereafter called the audio signal is transmitted via the antenna 18. The various power requirements are met by the power supply 19.

The second sub-system, or disaster alert module 20, is remotely located and is not physically connected to the first sub-system in any way. First and second signals, module activation and audio signals respectively, transmitted by the central disaster alert station 10 are received by the antenna 21, and are fed to the RF receiver 22. The RF receiver circuits are powered by the low-power output of the battery power supply 23, and operate in a low-power standby mode at all times. The decoder 24 is also powered by the same low-power supply line, and also remains in continuous low-power standby mode. The output of the RF receiver circuits 22, which is a conditioned version of the received signal, is supplied to the decoder 24, which analyzes the signal for the presence of the pre-selected coded module activation signal. The particular activation signal required by a given disaster alert module is a member of the set of a plurality of possible module activation signals which can be transmitted by the central disaster alert station, and which is appropriate for the geographic area and/or official personnel.

According to the teachings of the present invention, detection of the proper activation signal by the decoder 24, results in activation of the decoder controlled power switch 25, which is a gate controlling the application of the high power output of the battery power supply 23, to a plurality of module output means.

The first module output means is a clearly audible alarm 26, such as, but not limited to, a buzzer. The second module output means is a visual alarm 27 such as, but not limited to, a flashing light. The third module output means consists of a demodulator and audio amplifier 28, and an audio output unit 29 such as, but not limited to, a loudspeaker, to which the demodulator and audio amplifier 28 are connected. The fourth module output means is an auxiliary unit control 30 which may activate desirable auxiliary units such as, but not limited to, a standard television set or conventional radio receiver 31, a public address system 32, or civil defense sirens or alarms 33, said auxiliary units having been adapted or retro-fitted with said disaster alert modules.

Additionally, specially designated disaster alert modules located near roadways or the like are equipped with an auxiliary unit control output means 30, which applies power to electronically controlled and/or electrically lighted road signs, or activates a mechanical release mechanism to display disaster alert information on conventional printed road signs designed for this purpose, all indicated by numeral 34. These specially designated roadside modules may also contain audible and/or visual alarm means 26 and 27.

The battery power supply 23 is continuously or occasionally re-charged by the charger 35, which is operated from a conventional A.C. power source. Each disaster alert module 20, may be enclosed in a single case and may plug directly into an A.C. wall outlet.

It will be obvious to those skilled in the art that the disaster alert module, designated by the numeral 20, provides a long duration low power consumption, remotely activated disaster alert device capable of operating in the standby mode, unattended for years, if necessary, and responsive to disaster alert warnings for many hours in the event of localized or general A.C. power failure.

As is also known to those skilled in the art, a number of methods exist for the selective and multiple coding of transmitted signals such as, but not limited to pulse position or pulse duration coding and multiple frequency tone coding. Further, pulse coding may also be facilitated using interrupted carrier techniques, and since its description is reasonably straight forward, it will be used in explaining the operational character of the present invention. The use of an interrupted radio frequency carrier for coding purposes, in this description, is in no way intended to limit coding techniques of the present invention.

Figure 2:
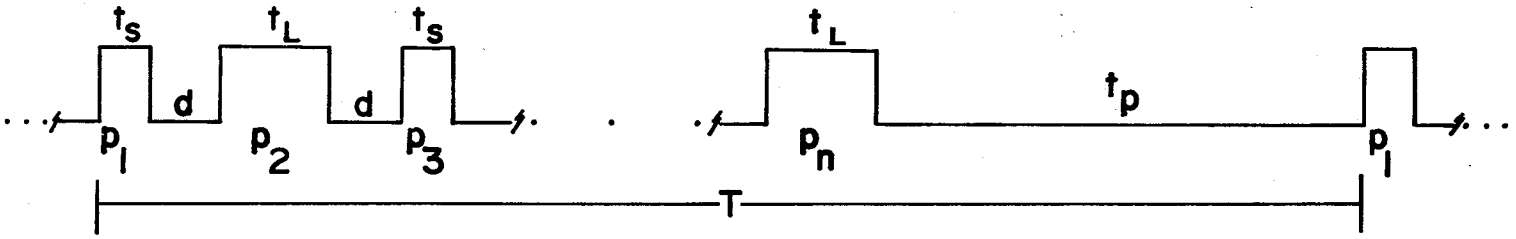
FIG. 2 is a diagram useful in explaining the operation of one embodiment of the invention.

The code itself may be described as consisting of a repeating frame containing n number of pulses, designated as $p_1$ through $p_n$, where n has any integer value greater than 1. Refer to FIG. 2. The duration and repetition rate of the code frame is variable according to the degree of noise immunity or operation security requirements, and to the electronic limitations of the system. The frame duration and frame repetition rate are designated as T and X respectively. The durations t of the n pulses are also variable within the total time constraint T of the frame duration. For digital coding purposes the individual pulse durations can take on either of two discrete values $t_s$ and $t_l$ representing short duration and long duration pulses respectively. These can be thought of as the commonly used representations of the binary digits 0 and 1, or off and on states, respectively. After the end of each pulse, a delay of d duration follows before the start of the next pulse, the delay between each pulse being independently variable. The remaining time $t_p$ in each frame after all n pulse durations and delays d are accounted for, is the synch pause, which is utilized, as will be shown later, to synchronize the actions of transmitter and receiver coding and decoding functions.

To those skilled in the art, it is apparent that the formation of a code frame of a particular sequence of n pulses each of either $t_s$ or $t_l$ durations, constitutes a unique n bit code word. Alterations of any or all of the said pulse durations of the n pulses constitutes a different code word.

Figure 3:
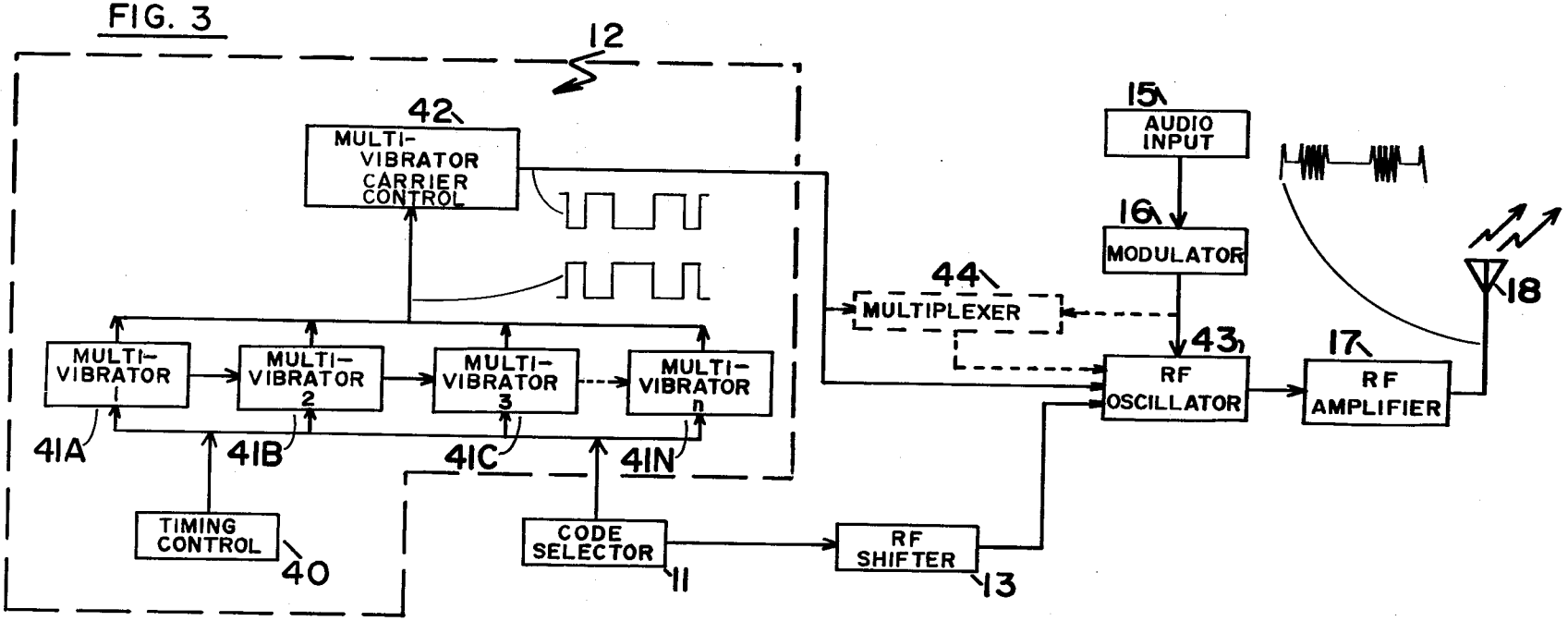
FIGS. 3 and 4 are partial block diagrams of various sub-systems in FIG. 1.

Attention is now directed to FIG. 3 which contains a block diagram of but one implementation of code input unit 12, which accomplishes the coding scheme described above. Each of the n number of multivibrators 41A through 41N controls the duration of their corresponding n pulses $p_1$ through $p_n$. Selection of a particular code with the code selector 11, results in setting each multivibrator for the appropriate pulse duration $t_s$ or $t_l$. The timing control 40, provides a signal which activates multivibrator #1, 41A. After time t, either $t_s$ or $t_l$ depending on the code, multivibrator #1 becomes quiescent, and provides a signal to multivibrator #2, 41B, which becomes active after a delay d. This sequence continues until all n multivibrators have become active and quiescent in turn. After time T from the start of pulse $p_1$, generated by multivibrator #1, the timing control 40 again activates multivibrator #1, thus repeating the code frame at a rate of 1/T or X. The synch pause time, $t_p$, is determined by the time remaining between the end of pulse $p_n$ and the onset of pulse $p_1$, controlled by multivibrators #1 and #n respectively. Repetition of the frame, as depicted in FIG. 2, at a rapid rate, constitutes the desired module activation code.

Each multivibrator 41A through 41N, when active, inhibits the multivibrator carrier control 42, thereby creating the logical compliment of the original code. The multivibrator carrier control is active only during the delays d, and during the sync pause $t_p$. Since the multivibrator carrier control 42 controls the RF oscillator 43, the latter being active when the former is active, the carrier wave produced by the RF oscillator 43 is interrupted at the times and for the durations when each of the n pulses $p_1$ through $p_n$ occurs, with precise duplication of the code frame timing sequence. The insets in FIG. 3 show the temporal relationship between the output signals of multivibrators 41A through 41N, the multivibrator carrier control 42, and the RF amplifier 17. The interrupted carrier is transmitted via the RF amplifier 17 and antenna 18.

The module activation code, produced in the manner just described, may be transmitted at a protected frequency prior to the transmission of the audio message, in which case during said module activation code transmission, RF shifter 13 acts on the RF oscillator 43 to shift the oscillator frequency to the protected frequency. During said audio message transmission the RF shifter is not active and the RF oscillator operates at its normal frequency.

Simultaneous transmission of the coded module activation signal and the audio signal are possible by multiplexing both signals onto the same frequency utilizing multiplexer 44 and omission of RF shifter 13. Alternatively, dual RF oscillators and RF amplifiers can be used to simultaneously transmit the module activation signal and the audio signal, the former on a protected frequency.

Figure 4:
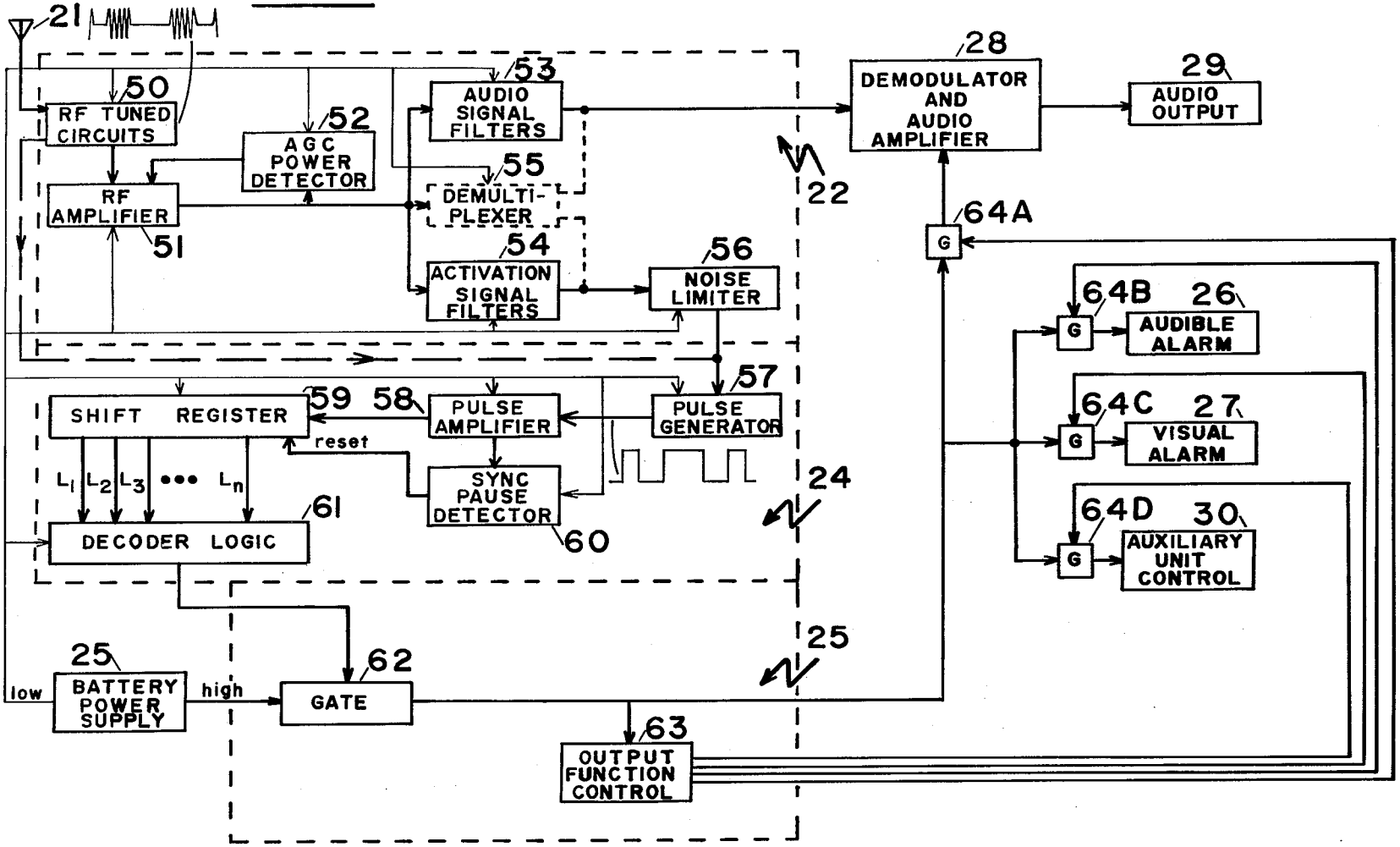

Refer now to FIG. 4 which contains block diagrams of but one possible implementation of the RF receiver 22, decoder 24, and power switch 25, which comprise portions of the disaster alert module 20. The RF tuned circuit(s) 50 are sensitive to the frequency(s) utilized by the central disaster alert station to transmit the coded module activation signal, and the audio signal. The outputs of the RF tuned circuits are supplied to the RF amplifier(s) 51, the gain(s) of which are controlled by the automatic gain control power detector 52. The automatic gain control prevents amplifier overloading when strong signals are received. The amplified signal is then passed through the audio signal filters 53, and activation signal filters 54, which would be utilized when said audio signal and said module activation signal are transmitted on separate frequencies. When both signals are multiplexed and transmitted simultaneously on the same frequency, a demultiplexer 55 replaces the filters 53 and 54.

Following filtering or demultiplexing, the module activation code signal is further conditioned by noise limiter 56, and fed to the pulse generator 57, which converts the interrupted carrier transform of the module activation code back into a train of pulses which is identical to that originally generated by the multivibrators 41A through 41N (of FIG. 3) in the central disaster alert station. The insets in FIG. 4 indicate the temporal relationship between the output signals of the RF tuned circuit(s) 50, and the pulse generator 57. Comparison of the insets of FIGS. 3 and 4 further demonstrate the comparability of the temporal relationships of the signals produced by the central disaster alert station, and the corresponding reproductions of said signals in the disaster alert module.

As is shown by the dashed line connecting the RF tuned circuit(s) 50 and pulse generator 57, the output of the RF tuned circuit(s) 50 may be directly applied to the pulse generator 57, when system demands are such that additional signal conditioning is not required, thus further reducing the power consumption requirements of the disaster alert module in the standby mode.

The pulse train output of the pulse generator 57 is conditioned additionally by pulse amplifiers 58, before being applied to the shift register 59. Sync pause detector 60 also receives the pulse train output of pulse amplifiers 58, and resets the shift register 59 whenever a pause equal to or greater than the shortest possible sync pause, $t_p$, occurs. The time constant of sync pause detector 60 is variable according to the requirements of the coding scheme used.

The $(n+1)$ stage shift register 59 receives the pulse train output of the pulse amplifiers 58, and advances one stage with the falling edge of each pulse, and supplies a voltage to the appropriate one of n logic lines, $l_1$ through $l_n$ for the duration, either $t_s$ or $t_l$, of the pulse. Assuming the shift register starts at rest, the first pulse, $p_1$, in a code frame causes a voltage to appear on logic line $l_1$ for the duration t, either $t_s$ or $t_l$, of the pulse $p_1$. Similarly pulse $p_2$ results in voltage application to logic line $l_2$, and so on through the sequence until pulse $p_n$ results in voltage application to logic line $l_n$. The sync pause detector 60 then detects the sync pause $t_p$, which is longer than any and all delays d, and resets the shift register 59 to its starting point, stage 1.

The resetting action of the sync pause detector 60 assures reliable synchronizing of the coding and decoding functions of the central disaster alert station 10, and the disaster alert modules 20. Even in the event of temporary interruption of the transmitted module activation signal, or of momentary accidental desynchronization of the shift register due to noise, the shift register will become re-synchronized within one frame repetition, upon detection of the sync pause, $t_p$.

Voltages appearing on logic lines $l_1$ through $l_n$ are applied to the decoder logic circuit 61. The decoder logic circuit analyzes the sequence and durations of the voltages on logic lines $l_1$ through $l_n$ for the proper activation code sequence of short and long durations, $t_s$ and $t_l$ respectively. Any given disaster alert module's logic circuit may be programmed to provide a power switching output signal upon detection of activation code frames consisting of any specified combination of short and long pulses, $t_s$ and $t_l$, appearing on any one or more specified logic lines $l_1$ through $l_n$. Further, the decoder logic circuit may be programmed to require some preselected number of appropriate frame repetitions before said power switching output signal is provided. To those skilled in the art, it is clear that such an arrangement is extremely immune to false triggering due to random noise and interference from other signals.

Application of said power switching output signal by the decoder logic circuit 61 to the gate 62 allows current to flow from the high power line of the battery power supply 25, through the gate 62, to the various output means 26 to 30 inclusive. Gate 62 may contain a timing element such that it shuts off automatically after a pre-selected time period. The output means may be further controlled by the output function control 63 which determines the sequence of output functions and their operation times by its actions on gates 64A through 64D. Such an arrangement may be desirable to prevent mutual interference between output functions.

Operation optimization and increased reliability of the present invention, disaster alert system, may be gained by providing a delta tuning means in the RF tuned circuit(s), 50, portion of the disaster alert modules, to accommodate long term changes in the electrical characteristics of components in the modules. Also, a simulated activation signal may be applied to the RF tuned circuits, 50, by means of a test button, in order to periodically check the disaster alert module's functional capability.

The auxiliary unit control 30 may provide alert functions for handicapped persons, by activation of special devices such as, but not limited to, Braille typewriters for the blind, and mechanical stimulators for the deaf, dumb and blind. The already disclosed output means, audible alarm 26, and visual alarm, 27 may be appropriately modified to provide salient alarms for the blind, and deaf respectively.

It is to be understood that the foregoing description relates to a specific embodiment of the invention illustrating the various features thereof, and inasmuch as the various modifications may be made to the circuit and other apparatus described above without departing from the spirit and scope of the invention, this description is not to be construed in a limiting sense. Consequently it is intended that the appended claims be interpreted to cover such modifications and equivalents.

What is claimed is:

1. A disaster alert system comprising:

a transmitting central disaster alert station and a plurality of receiving disaster alert modules said disaster alert modules being remotely located and independent of each other;

code selecting means in said central disaster alert station for selecting a module activation code, from a plurality of possible codes ($2^n$), designating the selected disaster alert module(s) to be activated;

coder input means in said central disaster alert station for generating repeating frames of said selected module activation code;

radio frequency (RF) circuit means in said central disaster alert station for converting said frames of said selected module activation code to a modulated RF first signal of a selected carrier frequency;

audio input means in said central disaster alert station for accepting live or pre-recorded audio disaster information messages;

RF circuit means in said central disaster alert station for converting said audio input to an audio modulated RF second signal of a selected carrier frequency.

RF amplifier means in said central disaster alert station for amplifying said RF first and second signals;

RF transmitting means in said central disaster alert station for transmitting said RF first and second signals;

RF receiver means in said disaster alert module for receiving said first and second signals;

decoder means in said disaster alert module for analyzing RF signals at said selected carrier frequency of said first signal, and providing a power switching output signal upon detecting the module activation code appropriate for said designated disaster alert modules;

rechargeable battery power supply means in said disaster alert module for providing a continuous low power output, and a switchable high power output, said RF receiver means and said decoder means in said disaster alert module remaining in continuous standby condition and powered by said low power output;

power switching means in said disaster alert module, activated by said power switching output signal of said decoder means, for applying said high power output to a plurality of module output means;

first module output means in said disaster alert module for providing a clearly audible alarm;

second module output means in said disaster alert module for providing a clearly visible alarm;

third module output means in said disaster alert module for demodulating and amplifying said RF second signal and reproducing said audio disaster information messages;

fourth module output means in said disaster alert module for controlling desired auxiliary units consisting of a plurality of alarm or warning devices of specialized purpose;

module output function control means in said disaster alert module for controlling the sequencing and durations of operation of said module output means, when appropriately activated by said disaster alert module decoding means.

2. The arrangement as recited in claim 1 wherein a charging circuit means in said disaster alert module is provided for continuous or periodic re-charging of said battery power supply means from AC or DC power sources.

3. The arrangement as recited in claim 1 wherein said power switching means in said disaster alert module contains a timing circuit which automatically terminates high power application to said module output means after a pre-selected time following decoder activation of said power switching means.

4. The arrangement as recited in claim 1 wherein said fourth module output means in said disaster alert module is utilized to activate auxiliary devices such as but not limited to standard television sets, conventional radio receivers, public address systems, civil defense sirens, special devices to alert handicapped persons, and any other device or devices which are desirable to be operated in time of existing or impending disaster, said auxiliary units having been modified or retro-fitted with said disaster alert modules.

5. The arrangement as recited in claim 1 wherein said fourth module output means in said disaster alert module is utilized to activate electronically controlled, or electronically lighted road signs, said road signs having been modified or retro-fitted with said disaster alert modules.

6. The arrangement as recited in claim 1 wherein said fourth module output means in said disaster alert module is utilized to activate a mechanical release mechanism to display a road sign or portion of road sign containing disaster alert information, said road sign or portion of road sign not being displayed unless disaster conditions exist, and said road sign having been modified or retro-fitted with said disaster alert modules.

7. The arrangement as recited in claim 1 wherein a test button means in said disaster alert module is provided which when depressed supplies a simulated module activation signal to said RF receiver means, thereby testing the disaster alert module's functional capability.

8. The arrangement as recited in claim 1 wherein said transmitting means in said central disaster alert station transmits said RF first signal prior to, and followed by said RF second signal, wherein both signals are transmitted at the same RF carrier frequency.

9. The arrangement as recited in claim 8 wherein said power switching means in said disaster alert module contains a timing circuit which automatically terminates high power application to said module output means after a pre-selected time following decoder activation of said power switching means.

10. The arrangement as recited in claim 1 wherein said transmitting means in said central disaster alert station transmits said RF first signal prior to, and followed by, said RF second signal, wherein both signals are transmitted at different RF carrier frequencies.

11. The arrangement as recited in claim 10 wherein said power switching means in said disaster alert module contains a timing circuit which automatically terminates high power application to said module output means after a pre-selected time following decoder activation of said power switching means.

12. The arrangement as recited in claim 1 wherein said transmitting means in said central disaster alert station transmits said RF first and second signals simultaneously, both signals being transmitted at the same RF carrier frequency, wherein a multiplexer is utilized to multiplex said RF first and second signals onto the same RF carrier frequency.

13. The arrangement as recited in claim 12 wherein said decoder means in said disaster alert module provides said power switching output signal to said power switching means so long as said decoder means detects said appropriate module activation code contained by said RF first signal.

14. The arrangement as recited in claim 1 wherein said transmitting means in said central disaster alert station transmits said RF first and second signals simultaneously, both signals being transmitted at different RF carrier frequencies.

15. The arrangement as recited in claim 14 wherein said decoder means in said disaster alert module provides said power switching output signal to said power switching means so long as said decoder means detects said appropriate module activation code contained by said RF first signal.

16. A disaster alert system comprising:

a plurality of disaster alert modules each being remotely located from a central transmitter, and each being independent of the other said disaster alert modules;

RF receiving means in said disaster alert module for receiving RF first signals containing a module activation code designating the selected disaster alert modules to be activated;

RF receiving means in said disaster alert module for receiving audio modulated RF second signals containing an audio disaster alert information message;

decoder means in said disaster alert module for analyzing RF signals on a carrier frequency utilized by said RF first signal, and providing a power switching output signal upon detecting the module activation code appropriate for designated disaster alert modules.

rechargeable battery power supply means in said disaster alert module for providing a continuous low power output, and a switchable high power output, said RF receiver means and said decoder means in said disaster alert module remaining in continuous standby condition and powered by said low power output;

power switching means in said disaster module, activated by said power switching output signal of said decoder means, for applying said high power output to a plurality of module output means;

first module output means in said disaster alert module for providing a clearly audible alarm;

second module output means in said disaster alert module for providing a clearly visible alarm;

third module output means in said disaster alert module for demodulating and amplifying said RF second signal and reproducing said audio disaster information messages;

fourth module output means in said disaster alert module for controlling desired auxiliary units consisting of a plurality of alarm or warning devices of specialized purpose;

module output function control means in said disaster alert module for controlling the sequencing and durations of operation of said module output means, when appropriately activated by said disaster alert module decoding means.

17. The arrangement as recited in claim 16 wherein a charging circuit means in said disaster alert module is provided for continuous or periodic re-charging of said battery power supply means from AC or DC power sources.

18. The arrangement as recited in claim 16 wherein said power switching means in said disaster alert module contains a timing circuit which automatically terminates high power application to said module output means after a pre-selected time following decoder activation of said power switching means.

19. The arrangement as recited in claim 16 wherein said decoder means in said disaster alert module provides said power switching output signal to said power switching means so long as said decoder means detects said appropriate module activation code contained by said RF first signal.

20. The arrangement as recited in claim 16 wherein said fourth module output means in said disaster alert module is utilized to activate auxiliary devices such as but not limited to standard television sets, conventional radio receivers, public address systems, civil defense sirens, special devices to alert handicapped persons, and any other device or devices which are desirable to be operated in time of existing or impending disaster, said auxiliary units having been modified or retro-fitted with said disaster alert modules.

21. The arrangement as recited in claim 16 wherein said fourth module output means in said disaster alert module is utilized to activate electronically controlled, or electronically lighted road signs, said road signs having been modified or retro-fitted with said disaster alert modules.

22. The arrangement as recited in claim 16 wherein said fourth module output means in said disaster alert module is utilized to activate a mechanical release mechanism to display a road sign or portion of road sign containing disaster alert information, said road sign or portion of road sign not being displayed unless disaster conditions exist, and said road sign having been modified or retro-fitted with said disaster alert modules.

23. The arrangement as recited in claim 16 wherein a test button means in said disaster alert module is provided which when depressed supplies a simulated module activation signal to said RF receiver means, thereby testing the disaster alert module's functional capability.

* * * * *